US010454199B1

(12) United States Patent
Christiano et al.

(10) Patent No.: US 10,454,199 B1
(45) Date of Patent: Oct. 22, 2019

(54) ELECTRICAL CONNECTOR WITH TERMINAL POSITION ASSURANCE DEVICE

(71) Applicants: TYCO ELECTRONICS BRASIL LTDA, Braganca Paulista (BR); Tyco Electronics Canada ULC, Markham (CA)

(72) Inventors: Fabio Fortunato Christiano, São Paulo (BR); Zoran Krnetic, Mississauga (CA)

(73) Assignees: TE Connectivity Brasil Industria De Electronicos LTDA, Sao Paulo (BR); TYCO Electronics Canada ULC, Markham (CA)

( * ) Notice: Subject to any disclaimer, the term of this patent is extended or adjusted under 35 U.S.C. 154(b) by 0 days.

(21) Appl. No.: 16/015,317

(22) Filed: Jun. 22, 2018

(51) Int. Cl.

| | |
|---|---|
| ***H01R 13/424*** | (2006.01) |
| ***H01R 13/73*** | (2006.01) |
| ***H01R 13/52*** | (2006.01) |
| ***H01R 13/04*** | (2006.01) |

(52) U.S. Cl.
CPC ..... *H01R 13/424* (2013.01); *H01R 13/04* (2013.01); *H01R 13/5202* (2013.01); *H01R 13/73* (2013.01)

(58) Field of Classification Search
CPC .... H01R 23/7073; H01R 23/02; H01R 24/60; H01R 13/4362; H01R 13/4361; H01R 13/424; H01R 13/73; H01R 13/5202; H01R 13/04
USPC ..... 439/752, 595
See application file for complete search history.

(56) References Cited

U.S. PATENT DOCUMENTS

| | | | | |
|---|---|---|---|---|
| 4,436,361 A * | 3/1984 | McCleerey | H01R 13/4361 | 439/404 |
| 4,984,998 A * | 1/1991 | Duncan | H01R 13/627 | 439/352 |
| 5,358,427 A * | 10/1994 | Miwa | H01R 13/4362 | 439/595 |
| 5,385,491 A * | 1/1995 | Fry | H01R 13/422 | 439/595 |
| 5,458,511 A * | 10/1995 | Sasai | H01R 13/4368 | 403/326 |
| 5,971,815 A * | 10/1999 | Polgar | H01R 13/4361 | 439/752 |
| 6,004,158 A * | 12/1999 | Ward | H01R 13/4361 | 439/595 |
| 6,783,396 B1 * | 8/2004 | Osterhart | H01R 13/521 | 439/587 |

(Continued)

*Primary Examiner* — Gary F Paumen

(57) ABSTRACT

An electrical connector includes a housing, multiple blade terminals, and a terminal position assurance (TPA) device. The blade terminals are held within cavities of the housing. The blade terminals have two edge sides between two broad sides and a rib projecting from at least one of the two edge sides. The TPA device is coupled to the housing at a mounting end thereof and is movable relative to the housing between an unlock position and a lock position. The TPA device has a base plate that defines multiple terminal openings therethrough. The base plate includes ledges that jut out into the terminal openings. The ledges extend behind and align with the ribs of the corresponding blade terminals when the TPA device is in the lock position to retain the blade terminals within the housing by abutting against back shoulders of the ribs.

20 Claims, 11 Drawing Sheets

(56) References Cited

U.S. PATENT DOCUMENTS

| | | | | |
|---|---|---|---|---|
| 7,682,205 | B2 * | 3/2010 | Hall | H01R 13/4361 439/752 |
| 7,892,048 | B2 * | 2/2011 | Shi | H01R 13/4367 439/752 |
| 9,039,462 | B2 * | 5/2015 | Yoon | H01R 13/4365 439/752 |
| 2013/0316560 | A1 * | 11/2013 | Yoon | H01R 13/4365 439/345 |
| 2017/0352985 | A1 * | 12/2017 | Venkatesan | H01R 13/639 |
| 2018/0034197 | A1 * | 2/2018 | Lyon | H01R 13/42 |

* cited by examiner

ELECTRICAL CONNECTOR WITH TERMINAL POSITION ASSURANCE DEVICE

BACKGROUND

The subject matter herein relates generally to electrical connectors that have terminal position assurance devices or members to ensure that electrical terminals are properly loaded and secured within connector housings.

Electrical connectors typically include electrical terminals that are held within an insulative housing. The electrical terminals have to be properly positioned or seated within the housing to successfully mate to a corresponding electrical contact of a mating connector. If one or more of the terminals are not properly positioned, the connector may form a faulty connection when mated to a mating connector. It may be costly and/or difficult fix a faulty connection due to poor accessibility of the terminals within the connector, and a common remedy is to discard the entire connector.

Another concern with electrical connectors is retention of the terminals within the housing when in use. For example, some terminals can be exposed to significant forces towards a back or mounting end of the housing. The forces may be exerted on the terminals by mating contacts that push the terminals during the mating process, by tension on the cables attached to the terminals caused by human operators pulling the cables, or the like. Known terminals may be retained within a respective cavity of the housing via small complementary retention features, such as latches, on the terminal and the housing. However, the retention features may not be sufficiently robust to withstand the forces exerted on the terminals, causing the retention features to fail and allowing the terminals to be pulled out of position.

A need remains for an electrical connector having an attachable device or member that robustly secures the terminals in the cavities of the housing and ensures that the terminals are properly positioned in the housing prior to mating the connector to a complementary mating connector.

SUMMARY

In one or more embodiments of the present disclosure, an electrical connector is provided that includes a housing, multiple blade terminals, and a terminal position assurance (TPA) device. The housing has a mating end and a mounting end, and defines multiple cavities. The blade terminals are held by the housing within the cavities. The blade terminals have two edge sides between two broad sides and a rib projecting from at least one of the two edge sides. The TPA device is coupled to the housing at the mounting end and is movable relative to the housing between an unlock position and a lock position. The TPA device has a base plate that defines multiple terminal openings therethrough. The base plate includes ledges that jut out into the terminal openings. The ledges extend behind and align with the ribs of the corresponding blade terminals when the TPA device is in the lock position to retain the blade terminals within the housing by abutting against back shoulders of the ribs.

In one or more embodiments of the present disclosure, an electrical connector is provided that includes a housing, multiple blade terminals, and a TPA device. The housing has a mating end and a mounting end, and defines multiple cavities. The blade terminals are held by the housing within the cavities. The blade terminals have ribs projecting therefrom. The TPA device is coupled to the housing at the mounting end and movable relative to the housing between an unlock position and a lock position. The TPA device has a base plate that defines multiple terminal openings therethrough. Each terminal opening has a short region and a long region. The base plate includes ledges that jut out into the terminal openings along the short regions. The long regions of the terminal openings align with the cavities of the housing when the TPA device is in the unlock position such that the ledges are spaced apart from the ribs of the blade terminals. The short regions align with the cavities when the TPA device is in the lock position such that the ledges extend behind and align with the ribs of the blade terminals.

In one or more embodiments of the present disclosure, an electrical connector is provided that includes a housing, multiple blade terminals held by the housing, and a TPA device. The housing has a mating end and a mounting end, and defines multiple cavities. The blade terminals have mating segments disposed within the cavities and termination segments disposed beyond the mounting end of the housing. The termination segments include contact plates configured to be mechanically secured to electrical components. The mating segments have two edge sides between two broad sides, and ribs that project from the edge sides. The TPA device is coupled to the housing at the mounting end and movable relative to the housing between an unlock position and a lock position. The TPA device has a base plate that defines multiple terminal openings therethrough. The base plate includes ledges that jut out into the terminal openings. The ledges extend behind and align with the ribs of the corresponding blade terminals when the TPA device is in the lock position to retain the mating segments of the blade terminals within the housing by abutting against back shoulders of the ribs.

DETAILED DESCRIPTION

Figure 1:
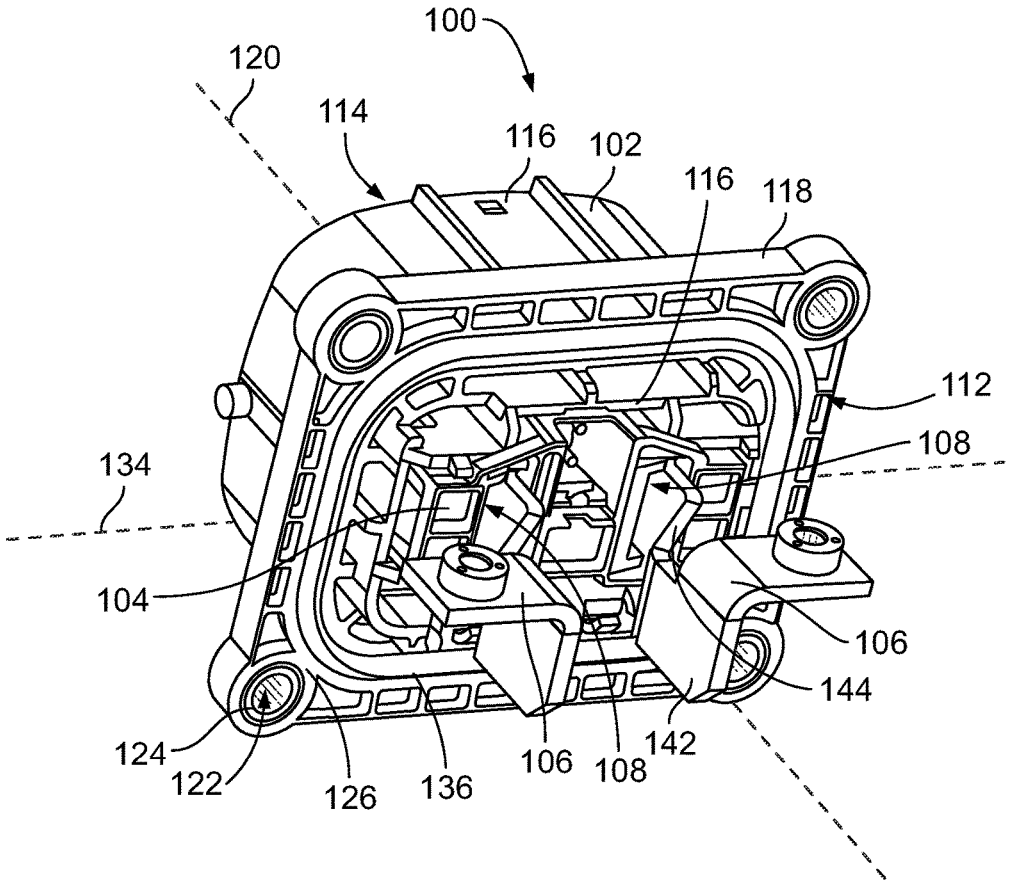
FIG. 1 is a perspective view of an electrical connector in accordance with an embodiment.
Figure 2:
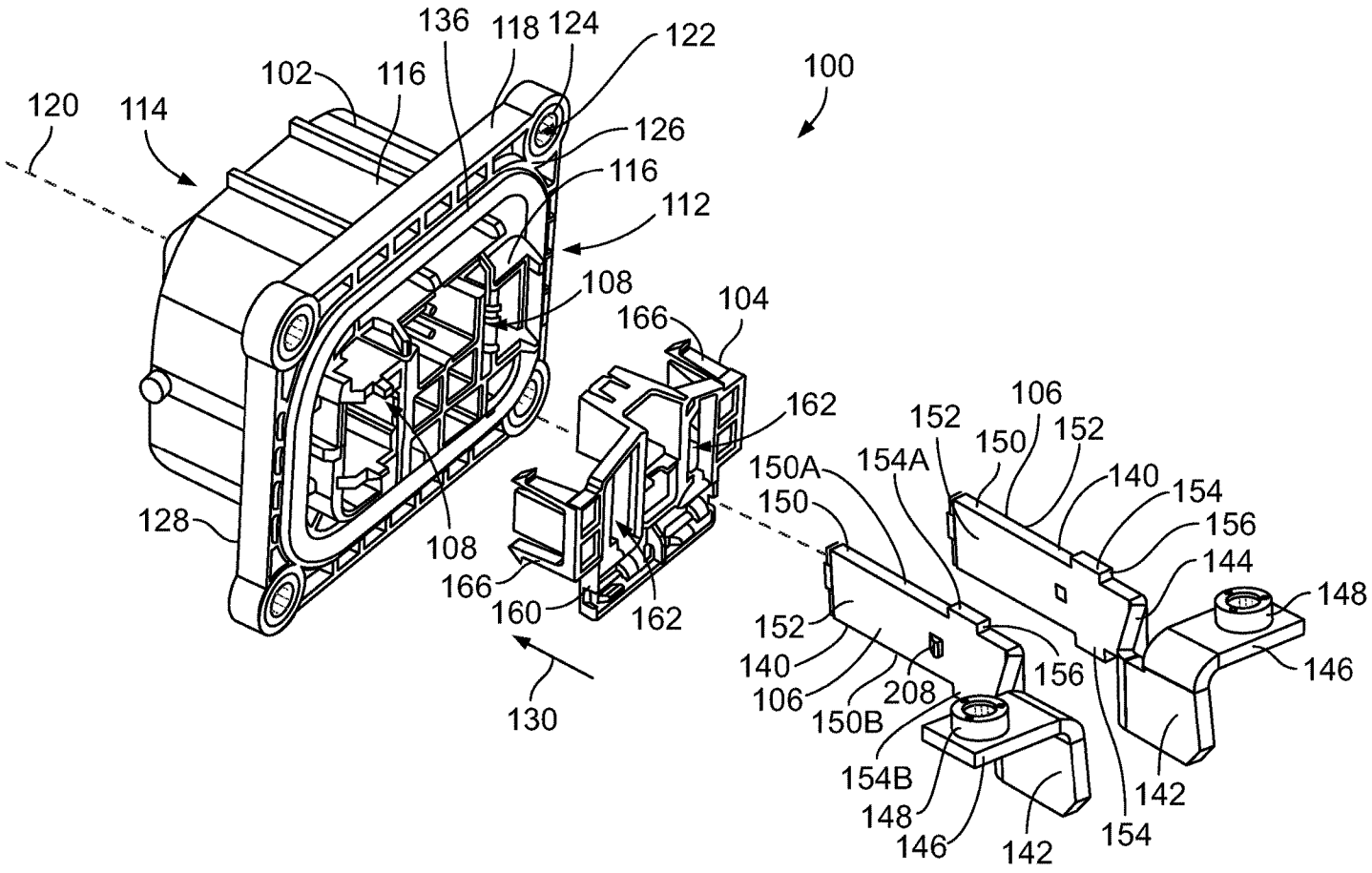
FIG. 2 is an exploded perspective view of the electrical connector according to an embodiment

FIG. 1 is a perspective view of an electrical connector 100 in accordance with an embodiment. FIG. 2 is an exploded perspective view of the electrical connector 100 according to an embodiment. The electrical connector 100 includes a housing 102, a terminal position assurance (TPA) device 104, and multiple blade terminals 106. The blade terminals 106 are held within corresponding cavities 108 of the housing 102. The blade terminals 106 protrude from the housing 102 at a mounting end 112 of the housing 102.

In the illustrated embodiment, the housing 102 has a mating end 114 opposite the mounting end 112. The mating end 114 defines a mating interface for engaging a mating connector (not shown) during a mating operation. The mating end 114 of the housing 102 may define a socket 110 (shown in FIG. 8) that receives a portion of the mating connector therein during the mating operation. The cavities 108 are open at the mounting end 112 and extend towards the mating end 114. For example, the terminals 106 may be loaded into the cavities 108 through the mounting end 112. The cavities 108 are fluidly connected (e.g., open) to the mating end 114. The cavities 108 may extend fully to the mating end 114 or may be open to the mating end 114 via the socket 110. Each blade terminal 106 is loaded into a different one of the cavities 108. The blade terminals 106 within the housing 102 are configured for electrically connecting to corresponding mating contacts of the mating connector to establish conductive pathways across the mating interface. In an embodiment, the cavities 108 are oriented parallel to one another and parallel to a cavity axis 120.

In FIG. 1, the housing 102 has an in-line or straight shape that extends linearly from the mounting end 112 to the mating end 114. The housing 102 may be elongated parallel to the cavity axis 120, such that the cavity axis 120 extends through both the mounting end 112 and the mating end 114. In an alternative embodiment, the housing 102 may have a right angle shape or another shape that is no in-line.

The electrical connector 100 optionally is a header connector that is configured to be mounted directly to a structure, such as a chassis, a case of a device, a wall, of the like. The electrical connector 100 is configured to mate with a mating connector, which may be a plug connector terminated one or more cables. The housing 102 in the illustrated embodiment includes a main body (portion) 116 and a mounting flange 118 connected to the main body 116. The mounting flange 118 is configured to be mechanically fastened to a panel or wall (not shown) of a structure to mount the connector 100 through an opening in the panel. The cavities 108 are defined by and extend through the main body 116. The mounting flange 118 projects outward (e.g., radially) from the main body 116. The mounting flange 118 is disposed at or proximate to the mounting end 112 of the housing 102.

The mounting flange 118 has a first side 126 that faces the panel (not shown) to which the connector 100 is mounted, and an opposite, second side 128 that faces towards the mating end 114. The first side 126 is also referred to herein as a panel-facing side 126. The mounting flange 118 optionally defines openings 122 therethrough for receiving fasteners (not shown), such as bolts and/or screws. The openings 122 may also hold compression limiters 124 or other bearings that extend between the fasteners and the flange 118 to protect the material of the flange 118.

Optionally, the electrical connector 100 may be a sealed connector that is configured to form a seal against the panel. The mounting flange 118 may include a compression seal 136 that is mounted to the panel-facing side 126 of the mounting flange 118. The compression seal 136 may include a rubber or rubber-like material that compresses when sandwiched between the panel-facing side 126 of the flange 118 and the panel to prevent debris and contaminants from passing through the interface the panel and the connector 100. The compression seal 136 in the illustrated embodiment is a hollow band that surrounds a perimeter of both the TPA device 104 and the main body 116, as shown in FIG. 1. Optionally, the compression seal 136 surrounds the perimeter of the TPA device 104 and the main body 116 without engaging either component. The compression seal 136 may be a gasket, an O-ring, or the like.

As shown in FIG. 1, the TPA device 104 couples to the housing 102 at the mounting end 112. As described in more detail herein, the TPA device 104 is movable relative to the housing 102 between an unlock position and a lock position. For example, during assembly, the TPA device 104 may be disposed in the unlock position, which represents a "pre-lock" configuration of the connector 100 that occurs during assembly of the electrical connector 100. Once the terminals 106 are loaded within the cavities 108, an operator may actuate the TPA device 104 to the lock position. In the lock position, the TPA device 104 supports retention of the terminals 106 in the housing 102. For example, the TPA device 104 may back up the terminals 106, which locks the terminals 106 in the cavities 108 by blocking the terminals 106 from retreating through the mounting end 112 of the housing 102. The TPA device 104 may provide a secondary means of retaining the terminals 106 in the housing 102, or, alternatively, may provide the primary and/or sole means of retaining the terminals 106 in the housing 102. As described in more detail herein, the TPA device 104 is configured to increase the permissible amount of force that can be exerted on the terminals 106 before the terminals 106 are forced out of fixed positions within the housing 102. For example, the use of TPA device 104 may enable each of the terminals 106 to meet and exceed requirements according to designated standards, such as being able to withstand forces up to 450 N or the like.

The TPA device 104 also provides terminal position assurance to indicate if any of the terminals 106 are not properly positioned within the housing 102. For example, if one or more of the terminals 106 are not fully loaded within the corresponding cavity 108, the connector 100 is designed such that the TPA device 104 is obstructed from attaining the lock position. The mechanical obstruction experienced when attempting to move the TPA device 104 to the lock position provides a tactile, audible, and/or visual indication that one or more of the components of the connector 100 are mispositioned, misshaped, and/or defective. For example, the obstruction may indicate that at least one of the blade terminals 106 is not fully loaded within the housing 102 to the designated position. The TPA device 104 may be at least partially composed of a dielectric material, such as one or more plastics, and optionally may be strengthened by fibers of glass and/or carbon. Alternatively, the TPA device 104 may include one or more metals. The TPA device 104 may be formed by a molding process.

In one or more embodiments described herein, the TPA device 104 is configured to load onto the mounting end 112 of the housing 102 in a loading direction 130 that is parallel to the cavity axis 120. The TPA device 104 is configured to load to the unlock position to achieve the pre-lock configuration. Furthermore, the TPA device 104 is configured to be actuated between the unlock and lock positions along an actuation axis 134 (shown in FIG. 1) that is transverse to the loading direction 130 and the cavity axis 120. In the illustrated embodiment, the actuation axis 134 is perpendicular to the cavity axis 120. Thus, the TPA device 104 may load onto the housing 102 parallel to the cavity axis 120 and may move perpendicular to the cavity axis 120 between the unlock and lock positions.

In one example application, the electrical connector 100 may be installed within an electric vehicle, such as a fully electric vehicle, a plug-in hybrid vehicle, or the like. The electrical connector 100 may represent part of, or may connect to, a charger inlet harness that is used to convey electric power for charging a battery of the electric vehicle. For example, the electrical connector 100 may be mounted to a panel of a battery pack, and the blade terminals 106 of the connector 100 may electrically connect and mechanically engage electrical bus bars or other current-carrying components of the battery pack. The electrical connector 100 is not limited to use in electric vehicles, and may be used in various other applications, such as in appliances, industrial machinery, and the like.

As shown in FIG. 2, the blade terminals 106 have a mating segment 140, a termination segment 142, and a transition segment 144 between the mating segment 140 and the termination segment 142. The mating segments 140 may be linear and extend through the cavities 108 of the housing 102. The termination segments 142 are configured for electrically connecting and mechanically securing to corresponding electrical components, such as circuit boards, bus bars, cables, or the like. In the illustrated embodiment, the termination segments 142 include contact plates 146 that are configured to be mechanically secured via fasteners 148 in direct engagement with electrical bus bars (not shown), circuit boards, or the like. The transition segments 144 have contoured trajectories that optionally resemble S-shaped curves. As shown in FIG. 1, the transition segments 144 and the termination segments 142 may be located outside of the housing 102 when the blade terminals 106 are fully loaded into the cavities 108.

The mating segments 140 of the blade terminals 106 have two edge sides 150 and two broad sides 152. The edge sides 150 extend between the broad sides 152. For example, in the illustrated orientation shown in FIG. 2, the edge sides 150 represent top and bottom sides of the terminals 106, and the broad sides 152 represent left and right sides of the terminals 106. As used herein, relative or spatial terms such as "top," "bottom," "left," "right," "upper," and "lower" are only used to identify and distinguish the referenced elements in the illustrated orientations and do not necessarily require particular positions or orientations in the surrounding environment of the electrical connector 100. The edge sides 150 are narrower than the broad sides 152.

Each of the blade terminals 106 has a rib 154 projecting from at least one of the two edge sides 150. Due to the rib 154 projecting from the edge side 150, the broad sides 152 of the blade terminals 106 are wider in the location of the rib 154 than along lengths of the blade terminals 106 bordering the rib 154. The rib 154 steps out from the blade terminal 106, such that the rib 154 has a back shoulder 156 that faces towards the termination segment 142. The back shoulder 156 of the rib 154 may be oriented perpendicular to the edge side 150.

In the illustrated embodiment, each of the blade terminals 106 has two ribs 154 projecting from different corresponding edge sides 150. For example, in the illustrated orientation, the two ribs 154 include an upper rib 154A projecting from a first edge side 150A and a lower rib 154B projecting from a second edge side 150B. The upper and lower ribs 154A, 154B of each terminal 106 are disposed at the same location along the length of the mating segment 140. The blade terminals 106 in an embodiment are stamped and formed of one or more metals, but may be molded in an alternative embodiment.

The blade terminals 106 may be high voltage power terminals that are configured to convey DC electric power at high voltages. For example, the blade terminals 106 may be configured to convey DC power at voltages up to (or exceeding) 400 volts (V). In a non-limiting example, the blade terminals 106 may be designed to convey voltages in excess of 300 V, and optionally up to 413 V. The blade terminals 106 in a non-limiting example application may represent components of a DC fast charge line for charging electric vehicles.

The TPA device 104 has a base plate 160 that defines multiple terminal openings 162 therethrough. Each of the terminal openings 162 is configured to receive a different one of the blade terminals 106 therein. The base plate 160 defines two terminal openings 162 in the illustrated embodiment to accommodate the two blade terminals 106. When the TPA device 104 is coupled to the housing 102, the base plate 160 is positioned at the mounting end 112 of the housing 102, and the terminal openings 162 align with the cavities 108 of the housing 102. As the blade terminals 106 are loaded into the connector 100 during assembly, the blade terminals 106 pass through the terminal openings 162 before entering the cavities 108 of the housing 102. The TPA device 104 also includes mounting latches 166 and other features that protrude from the base plate 160 into corresponding recesses and apertures in the housing 102 for coupling the TPA device 104 to the housing 102. The mounting latches 166 and other features that protrude from the base plate 160 do not extend into the cavities 108.

Figure 3:
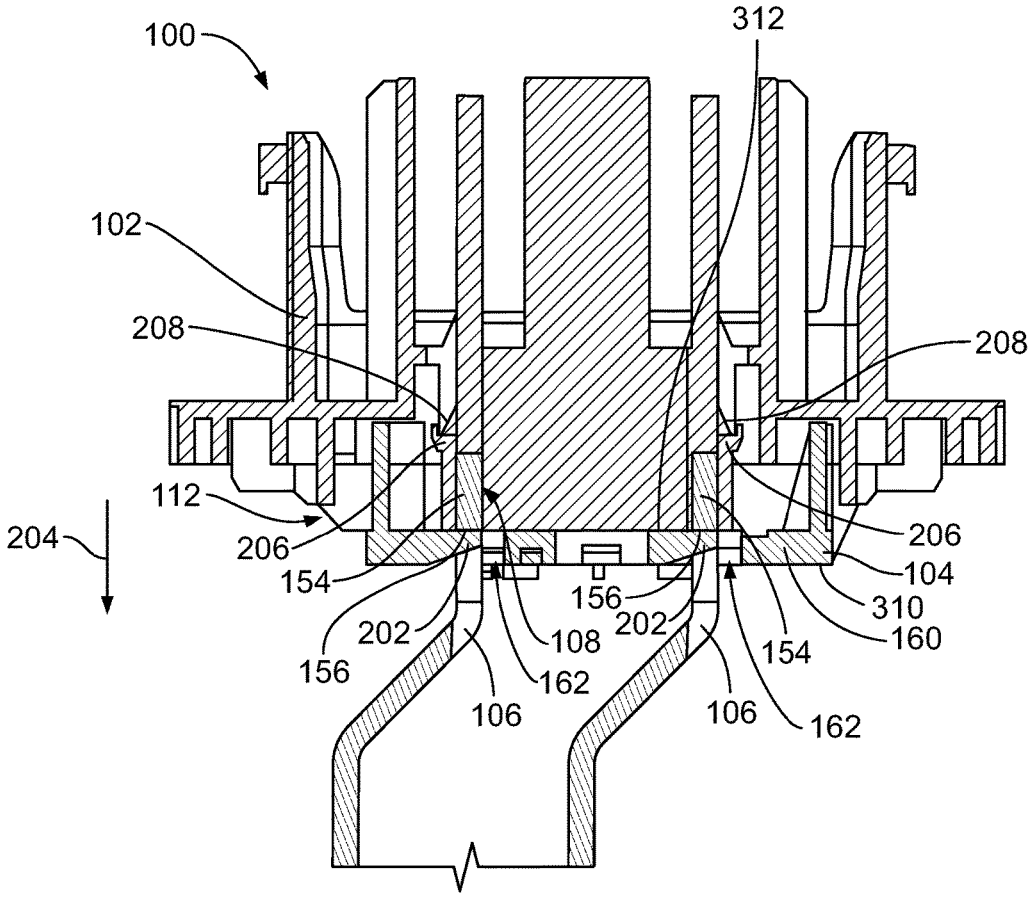
FIG. 3 is a top down cross-sectional view of the electrical connector according to an embodiment.

FIG. 3 is a top down cross-sectional view of the electrical connector 100 according to an embodiment. The electrical connector 100 is in the assembled state. The cross-section line extends through one rib 154 on each of the two blade terminals 106. The blade terminals 106 are both fully loaded in the corresponding cavities 108 of the housing 102. The TPA device 104 is coupled to the housing 102 at the mounting end 112 and is in the lock position relative to the housing 102. The base plate 160 of the TPA device 104 may be planar and relatively thin, such that the TPA device 104 is relatively compact.

The TPA device 104 in the lock position provides a locking mechanism to retain the blade terminals 106 in the fully loaded positions within the housing 102. In the lock position, portions of the TPA device 104 along the base plate 160 extend behind and align with the ribs 154 of the blade terminals 106. In the illustrated embodiment, the portions of the TPA device 104 that extend behind the ribs 154 are ledges 202 that jut out into the terminal openings 162 of the base plate 160. The ledges 202 extend into the retreat paths of the terminals 106, such that the ledges 202 extend into the spaces behind the ribs 154 of the terminals 106 without extending into the cavities 108 of the housing 102.

During installation and/or use of the connector 100, forces may be exerted on the blade terminals 106 in a rearward direction 204 that would urge the terminals 106 to back out of the cavities 108 through the mounting end 112. The forces may be due to a mating connector pushing the blade terminals 106 rearward or tension applied on the blade terminals 106 due to relative movement between the connector 100 and the electrical components to which the termination segments 142 (FIG. 2) of the blade terminals 106 are mounted. The TPA device 104 is designed to withstand such forces to retain the terminals 106 in position because the back shoulders 156 of the ribs 154 abut against the ledges 202. The contact between the ribs 154 and the ledges 202 transfers forces to the TPA device 104, which may be robustly mounted to the housing 102.

In the illustrated embodiment, the TPA device 104 provides secondary retention of the blade terminals 106 within the cavities 108. For example, the housing 102 includes deflectable locking latches 206 within the cavities 108. The blade terminals 106 have locking protrusions 208 (shown also in FIG. 2) disposed along one of the broad sides 152 (FIG. 2). When the blade terminals 106 attain the fully loaded positions, the locking protrusions 208 engage and catch on the corresponding locking latches 206 to provide primary retention of the blade terminals 106 within the cavities 108. The primary retention may be insufficient to withstand certain amounts of force, such as a designated amount of force that is set by a connector regulation or standard. The TPA device 104 may provide secondary retention to supplement the locking latches 206 of the housing 102 in the task of retaining the blade terminals 106 in the cavities 108. For example, the TPA device 104 may increase the amount of force on the terminals 106 that the connector 100 can withstand to levels that exceed applicable regulations and/or standards. In a non-limiting example, the connector 100 with the TPA device 104 may be able to withstand forces up to or exceeding 450 N on each blade terminal 106 without the blade terminals 106 moving out of position within the housing 102.

Figure 11:
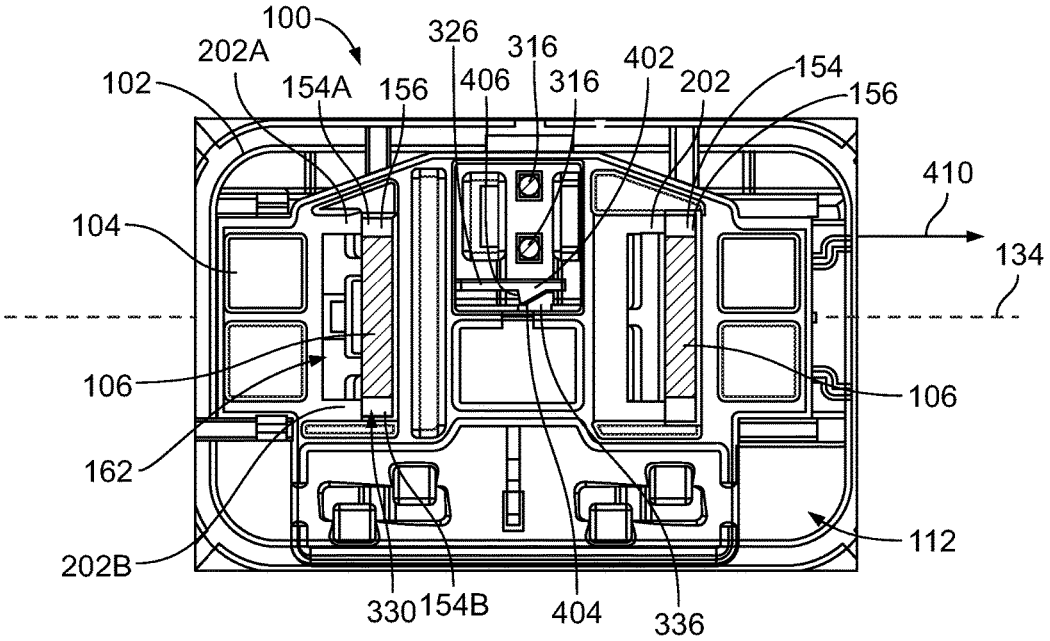
FIG. 11 is a cross-sectional view of the mounting end of the electrical connector with the TPA device in an unlock position according to an embodiment.

In an embodiment, when the TPA device 104 is in the unlock position, as shown in FIG. 11, the ledges 202 do not extend into the retreat paths of the ribs 154. Therefore, the blade terminals 106 can be loaded into the cavities 108 of the housing 102 and unloaded out of the cavities 108 when the TPA device 104 is in the unlock position.

Figure 4:
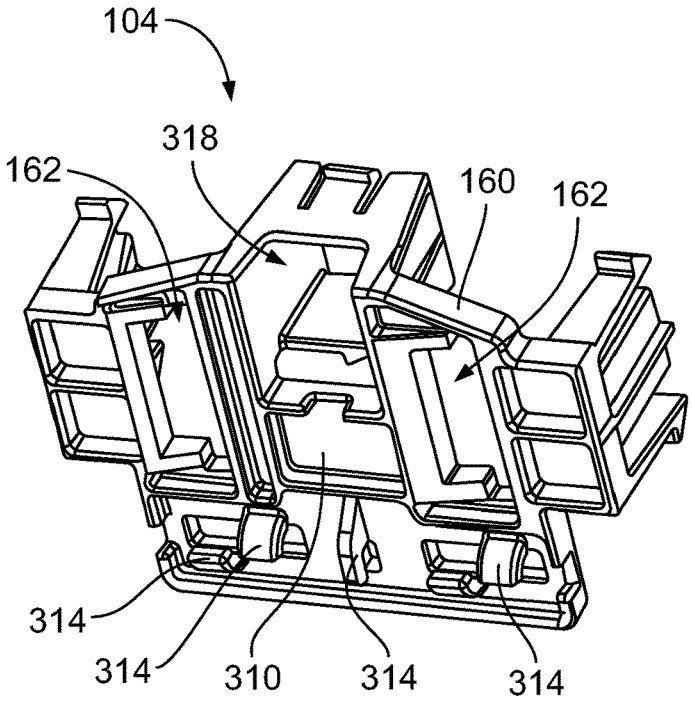
FIG. 4 is a perspective view of a terminal position assurance (TPA) device of the electrical connector showing an outer side of a base plate of the TPA device.
Figure 5:
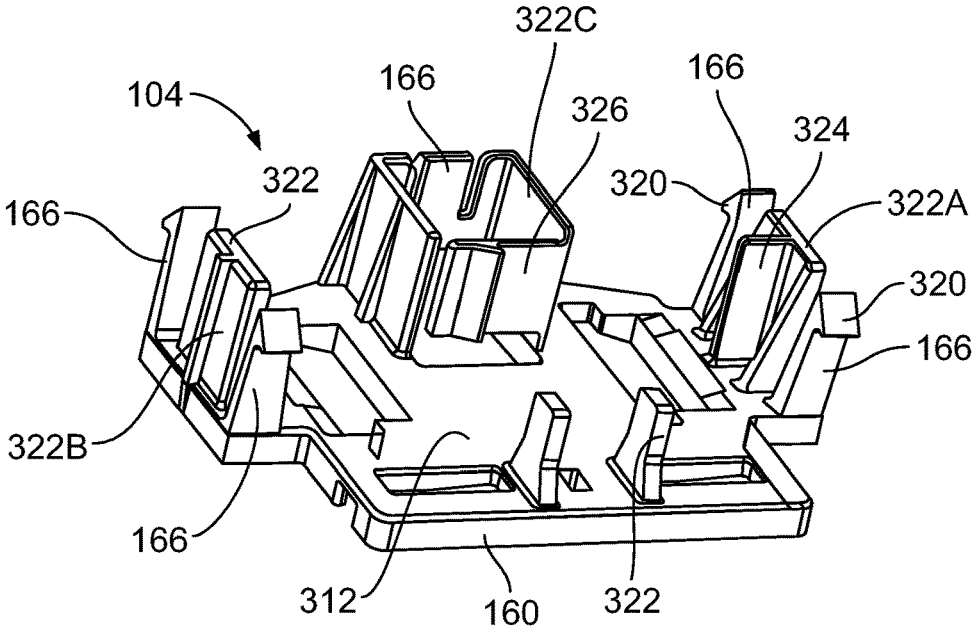
FIG. 5 is a perspective view of the TPA device showing an inner side of the base plate that is opposite the outer side.
Figure 6:
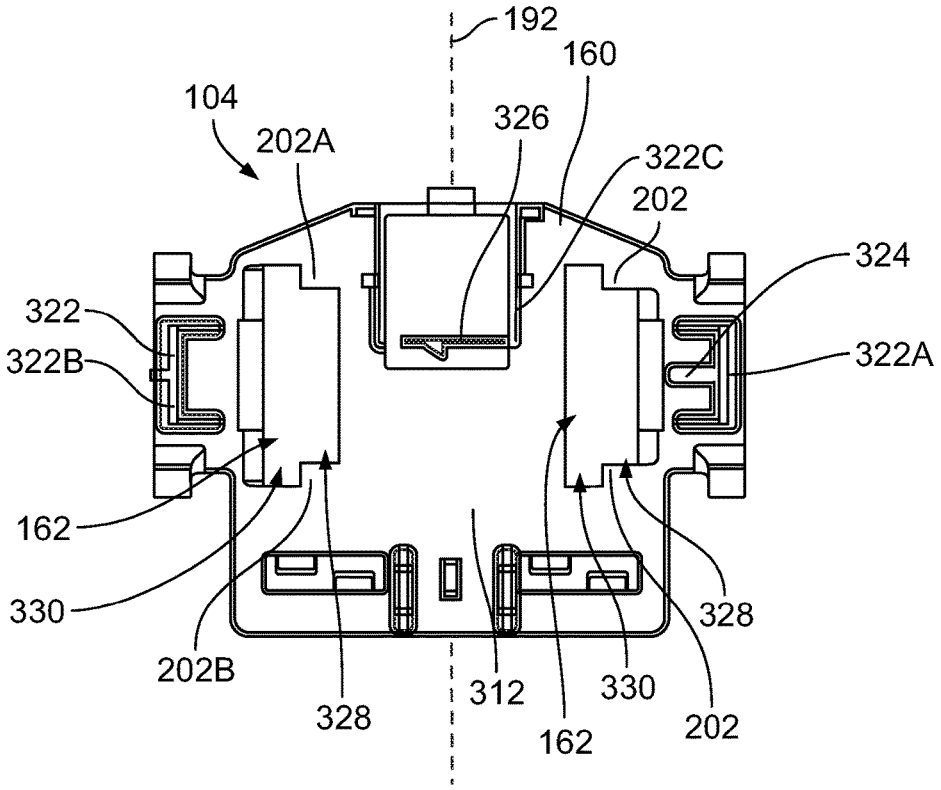
FIG. 6 is a plan view of the TPA device showing the inner side of the base plate.

FIGS. 4-6 show different views of the TPA device 104 of the electrical connector 100 according to an embodiment. For example, FIG. 4 is a perspective view of the TPA device 104 showing an outer side 310 of the base plate 160. FIG. 5 is a perspective view of the TPA device 104 showing an inner side 312 of the base plate 160. FIG. 6 is a plan view of the TPA device 104 showing the inner side 312 of the base plate 160. The inner side 312 is opposite the outer side 310. As shown in FIG. 3, when the TPA device 104 is coupled to the housing 102, the inner side 312 of the base plate 160 faces (and may engage) the housing 102, and the outer side 310 faces away from the housing 102.

As shown in FIG. 4, the TPA device 104 may have cable routing fingers 314 that project from the outer side 310 of the base plate 160. The cable routing fingers 314 are designed to engage and control the positioning of one or more cables 316 (shown in FIG. 9) of the connector 100 that extend through the TPA device 104. The cables 316 may convey data and/or control signals, such as for a high voltage interlock circuit. The TPA device 104 defines a central recess 318 through which the cables 316 may be routed. The central recess 318 is disposed between the two terminal openings 162.

As shown in FIG. 5, the TPA device 104 includes several mounting latches 166 that project from the inner side 312. The mounting latches 166 have respective hook tips 320 that engage the housing 102. In the illustrated embodiment, the TPA device 104 has five mounting latches 166 that are spaced apart along the base plate 160. The mounting latches 166 are spaced apart to provide the TPA device 104 with a wide coupling stance on the housing 102 for stability. The TPA device 104 also includes alignment posts 322 that project from the inner side 312 of the base plate 160. The alignment posts 322 and the mounting latches 166 extend into the housing 102 beyond the mounting end 112 when the TPA device 104 is coupled to the housing 102. The alignment posts 322 may guide the TPA device 104 into a designated proper orientation and position relative to the housing 102, and may also serve as keying members to block attempted coupling of the TPA device 104 in a non-designated orientation or position. For example, one alignment post 322A between two mounting latches 166 has a keying feature 324 that projects from the alignment post 322A towards an opposite alignment post 322B. The alignment post 322B lacks a keying feature such that the alignment posts 322A, 322B have different shapes. The housing 102 is designed to accommodate the alignment posts 322A, 322B in only a single orientation of the TPA device 104 to ensure proper coupling.

As shown in FIGS. 5 and 6, the TPA device 104 has a position-retaining latch 326 that extends from an alignment post 322C and is elongated transverse to the mounting latches 166. The position-retaining latch 326, as described in more detail herein, is configured to prohibit premature actuation of the TPA device 104 from the unlock position to the lock position. Once the TPA device 104 is moved to the lock position, the position-retaining latch 326 is configured to retain the TPA device 104 in the lock position by prohibiting unintended actuation of the TPA device 104 towards the unlock position.

The plan view in FIG. 6 shows the two terminal openings 162 defined in the base plate 160. The base plate 160 has at least one ledge 202 that juts out into each of the terminal openings 162. In the illustrated embodiment, two ledges 202, including a first ledge 202A and a second ledge 202B, jut out into each of the terminal openings 162, but a single ledge 202 may jut into each terminal opening 162 in an alternative embodiment. The ledges 202 are located at corners of the terminal openings 162. Due to the presence of the ledges 202, the terminal openings 162 have irregular cross-sectional shapes. For example, the cross-sectional shape of each terminal opening 162 has a short region 328 and a long region 330. The long region 330 has a greater length than the short region 328 along a longitudinal axis 192 of the connector 100. The short region 328 is defined between the two ledges 202. The long region 330 is spaced apart from the ledges 202. The blade terminals 106 (FIG. 3) extend through the long regions 330 when the TPA device 104 is in the unlock position. Movement of the TPA device 104 to the lock position causes the blade terminals 106 to be received into the short regions 328, allowing the ledges 202 to extend behind and align with the ribs 154 (FIG. 3) of the terminals 106.

Figure 7:
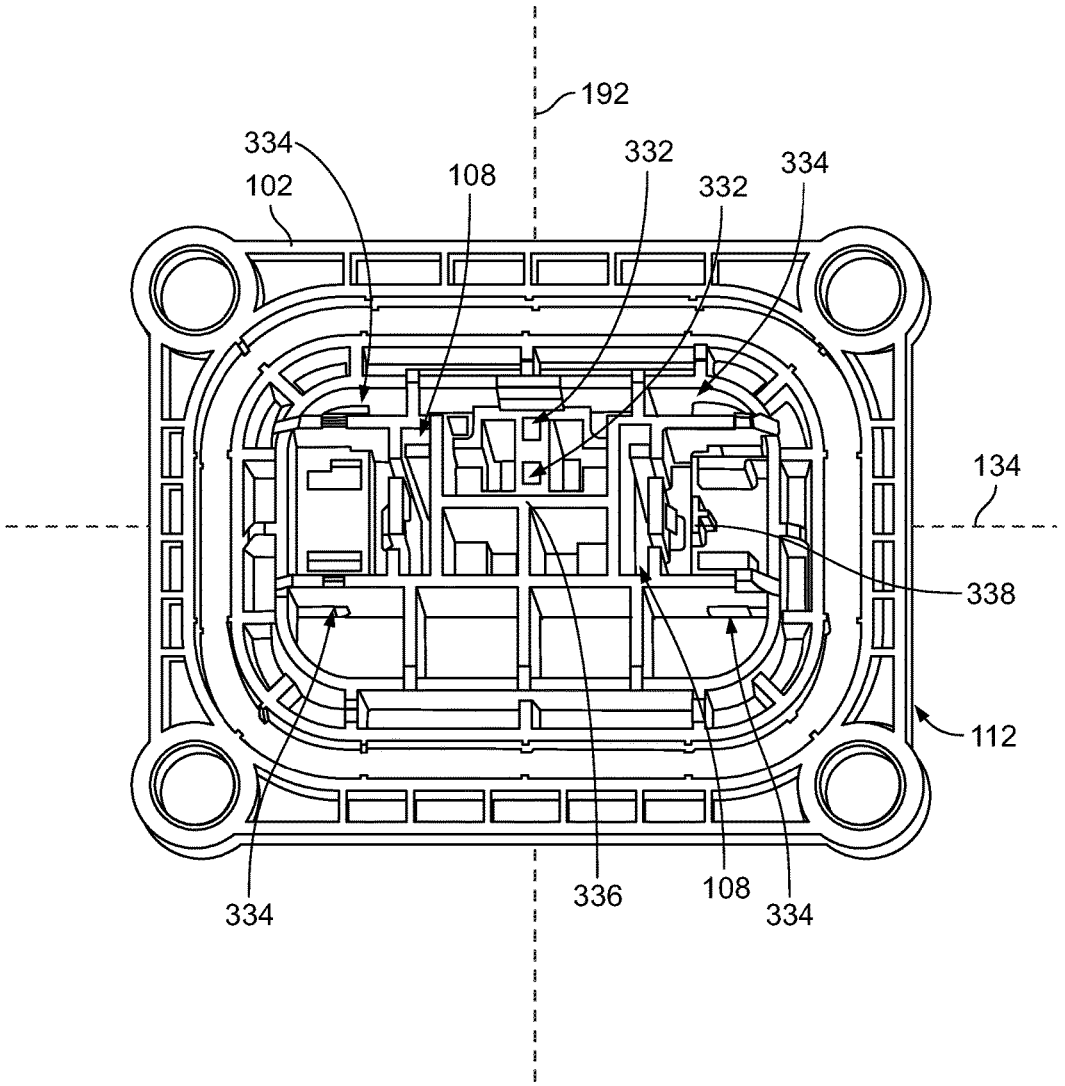
FIG. 7 is a perspective view showing a mounting end of a housing of the electrical connector according to an embodiment.

FIG. 7 is a perspective view showing the mounting end 112 of the housing 102 of the electrical connector 100 according to an embodiment. The housing 102 defines two cavities 108 for receiving the blade terminals 106 (FIG. 3). The housing 102 in the illustrated embodiment also includes cable apertures 332 located between the two cavities 108. The cable apertures 332 accommodate the cables 316 (shown in FIG. 9). The housing 102 defines multiple latch-receiving slots 334 that are configured to accommodate the mounting latches 166 (FIGS. 4 and 5) of the TPA device 104. The latch-receiving slots 334 are elongated parallel to the actuation axis 134 for distances greater than the widths of the mounting latches 166 to provide clearance for the mounting latches 166 to translate along the actuation axis 134 while disposed within the slots 334. The housing 102 also includes a catch feature 336 that projects transverse to the actuation axis 134. The catch feature 336 is designed to engage the position-retaining latch 326 (shown in FIGS. 5 and 6) of the TPA device 104. The housing 102 also includes at least one keying feature 338 that makes the mounting end 112 of the housing 102 asymmetrical relative to the longitudinal axis 192 of the connector 100. The keying feature(s) 338 interact with the alignment posts 322 of the TPA device 104 and ensure that the TPA device 104 is coupled to the housing 102 in the predetermined, designated position and orientation.

Figure 8:
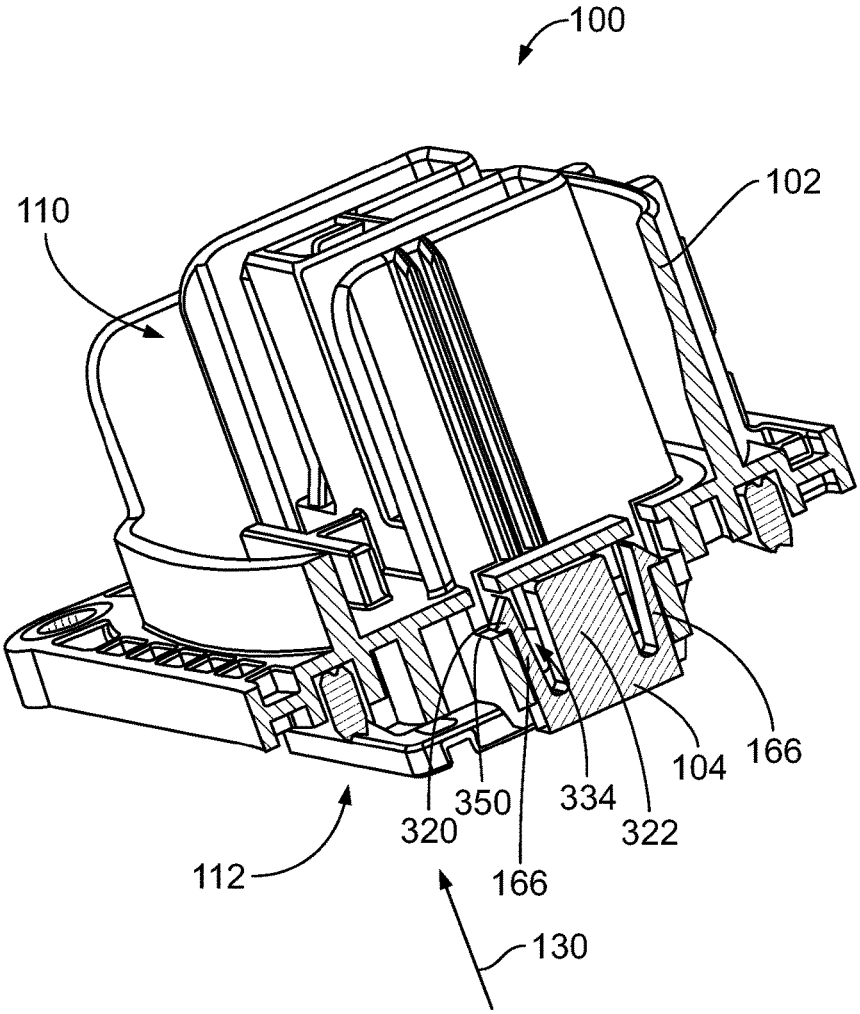
FIG. 8 is a cross-sectional perspective view of the TPA device coupled to the housing.

FIGS. 8-12 illustrate an assembly process of the electrical connector 100 according to an embodiment, including the coupling and actuation of the TPA device 104 relative to the housing 102. For example, FIG. 8 is a cross-sectional perspective view of the TPA device 104 coupled to the housing 102. The cross-section line extends through two of the mounting latches 166 and one alignment post 322 of the TPA device 104. As the TPA device 104 is loaded in the loading direction 130, the mounting latches 166 and alignment posts 322 penetrate the mounting end 112 of the housing 102. The mounting latches 166 are received in the latch-receiving slots 334 of the housing 102. The hook tips 320 of the mounting latches 166 catch on corresponding catch features of the housing 102 within the slots 334 to couple the TPA device 104 to the housing 102. In the illustrated embodiment, the housing 102 has elongated shelves 350 within the slots 334 that define the catch features. The hook tips 320 are able to slide along the shelves 350 with the translational movement of the TPA device 104 between the lock and unlock positions.

Figure 9:
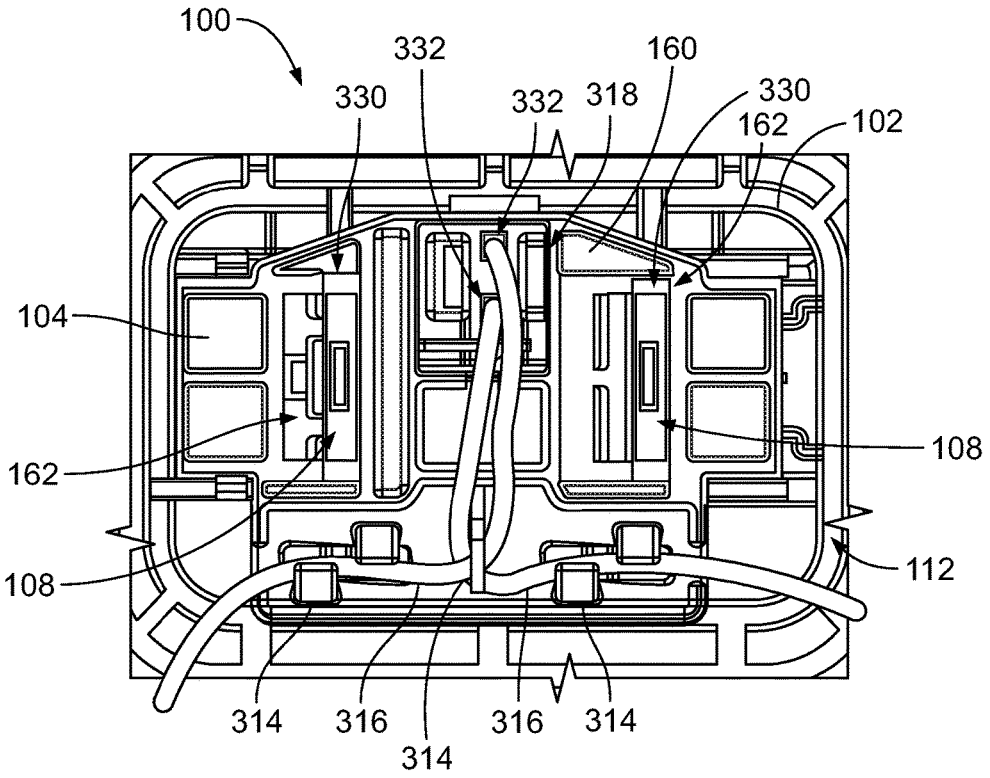
FIG. 9 shows the mounting end 112 of the electrical connector 100 without the blade terminals 106 loaded into the housing 102 according to an embodiment.

FIG. 9 shows the mounting end 112 of the electrical connector 100 without the blade terminals 106 loaded into the housing 102 according to an embodiment. The TPA device 104 is configured to load onto the housing 102 in the unlock position to achieve the pre-lock configuration. In the unlock position, the long regions 330 of the terminal openings 162 align with the cavities 108 of the housing 102. The illustrated embodiment shows two cables 316 that are routed through the cable apertures 332 of the housing 102. The cables 316 optionally may be components of a high voltage interlock circuit or system. The cables 316 project through the central recess 318 of the base plate 160 of the TPA device 104 and are routed in opposite directions from each other via the cable routing fingers 314 on the base plate 160. In the illustrated example, the cables 316 are routed using the cable routing fingers 314 before loading the blade terminals 106 (FIG. 3) in to the cavities 108, but the blade terminals 106 may be loaded into the cavities 108 prior to routing the cables 316 in an alternative embodiment.

Figure 10:
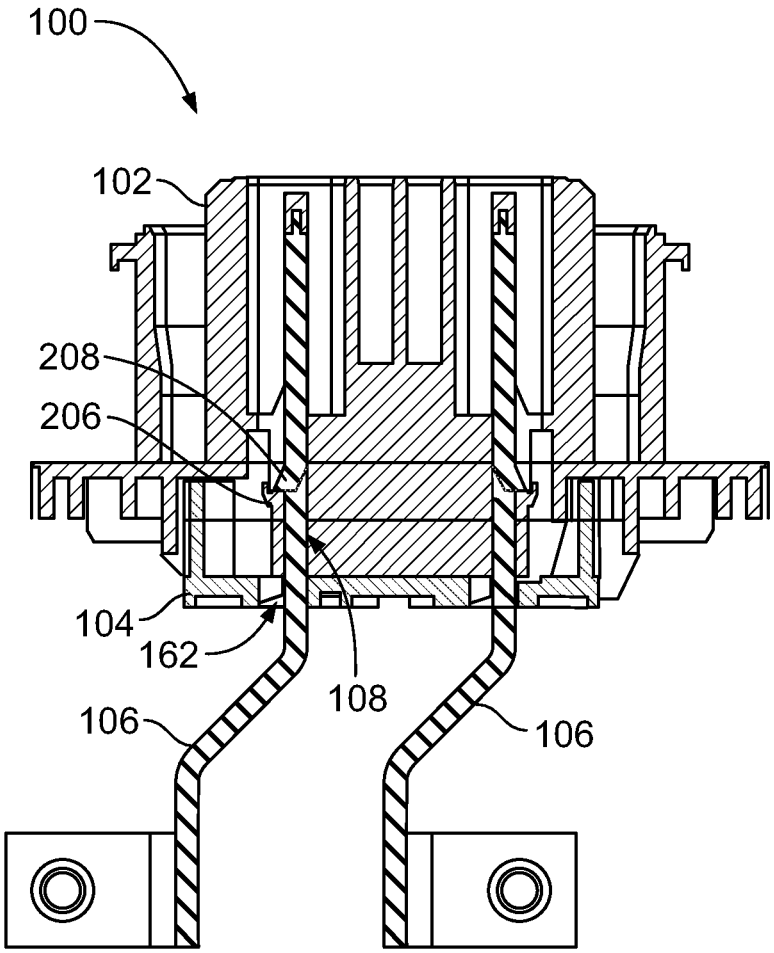
FIG. 10 is a top-down cross-sectional view of the electrical connector according to an embodiment.

FIG. 10 is a top-down cross-sectional view of the electrical connector 100 according to an embodiment. The cross-section line is taken through the blade terminals 106 but not through the ribs 154 (FIG. 2) thereof, so the ribs 154 are not visible in FIG. 10. The cables 316 are omitted in FIG. 10 for descriptive purposes. During assembly of the connector 100, the blade terminals 106 are loaded into the corresponding cavities 108 in the housing 102 through the corresponding terminal openings 162 in the TPA device 104. The TPA device 104 is in the unlock position while the blade terminals 106 are loaded. The blade terminals 106 attain the fully loaded positions within the cavities 108 upon the protrusions 208 of the terminals 106 engaging and catching on the locking latches 206 of the housing 102.

Figure 12:
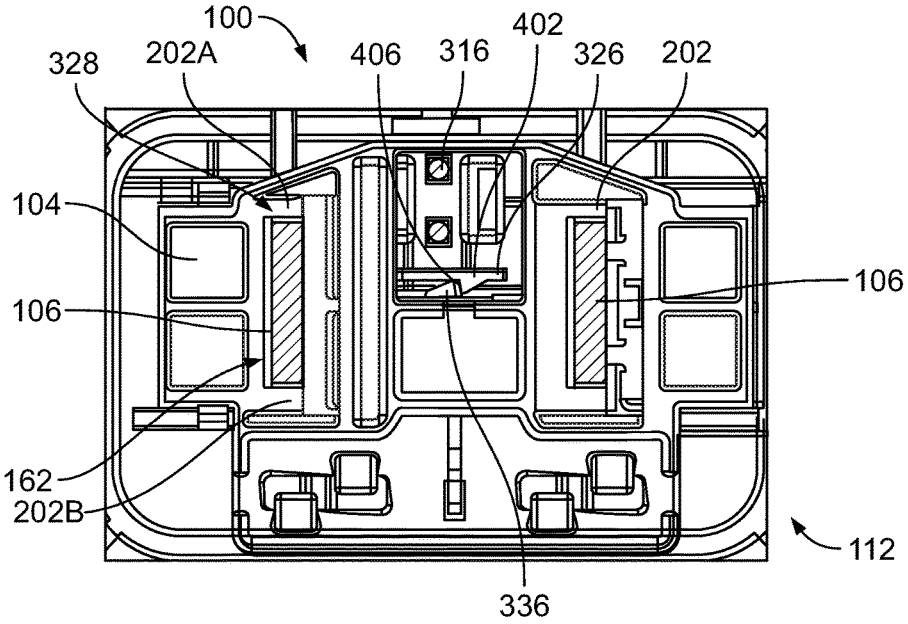
FIG. 12 is a cross-sectional view of the mounting end of the electrical connector with the TPA device in a lock position according to an embodiment.

FIG. 11 is a cross-sectional view of the mounting end 112 of the electrical connector 100 with the TPA device 104 in the unlock position according to an embodiment. FIG. 12 is a cross-sectional view of the mounting end 112 of the electrical connector 100 with the TPA device 104 in the lock position according to an embodiment. The cross-section lines in FIGS. 11 and 12 only extend through the blade terminals 106 and the cables 316.

The position-retaining latch 326 has a hook feature 402 with a ramp surface 404 and a catch surface 406. When the TPA device 104 is in the unlock position, as shown in FIG. 11, the ramp surface 404 engages the catch feature 336 of the housing 102. The engagement between the ramp surface 404 and the catch feature 336 prohibits unintentional premature actuation of the TPA device 104 to the lock position, but can be overcome by sufficient force in a loading direction 410 along the actuation axis 134. When the TPA device 104 is moved along the actuation axis 134 relative to the housing 102 to the lock position, as shown in FIG. 12, the catch surface 406 of the hook feature 402 engages the catch feature 336 of the housing 102. The position-retaining latch 326 may lock the TPA device 104 in the lock position. The engagement between the catch surface 406 and the catch feature 336 prohibits unintended actuation of the TPA device 104 towards the unlock position. To intentionally release the TPA device 104 from the lock position, an operator may manually force the TPA device 104 in a direction opposite the loading direction 410. Based on the orientations of the surfaces, more force is required to overcome the engagement between the catch surface 406 and the catch feature 336 shown in FIG. 12 (to unlock the TPA device 104) than the force required to overcome the engagement between the ramp surface 404 and the catch feature 336 (to lock the TPA device 104).

When the TPA device 104 is in the unlock position as shown in FIG. 11, the ledges 202 do not extend behind the ribs 154. For example, the long regions 330 of the terminal openings 162 align with the terminals 106 in the cavities 108 (shown in FIG. 9). The TPA device 104 translates in the locking direction 410 along the actuation axis 134 from the unlock position to the lock position. The movement in the locking direction 410 may be perpendicular to the movement of the TPA device 104 in the loading direction 130 along the cavity axis 120 (FIGS. 1 and 2) to couple the TPA device 104 to the housing 102.

In the lock position shown in FIG. 12, the short regions 328 of the terminal openings 162 align with the blade terminals 106 in the cavities 108. The ledges 202 back up the ribs 154, such that the ledges 202 extend behind and align with the back shoulders 156 of the ribs 154. As a result, the ledges 202 obstruct the view of the back shoulders 156 of the ribs 154 in FIG. 12. The first ledge 202A in each terminal opening 162 backs up the upper rib 154A of each corresponding blade terminal 106, and the second ledge 202B backs up the lower rib 154B. As described with reference to FIG. 3, the ledges 202 are configured to abut the back shoulders 156 of the ribs 154 to prevent the blade terminals 106 from being pushed or pulled out of the cavities 108.

Figure 13:
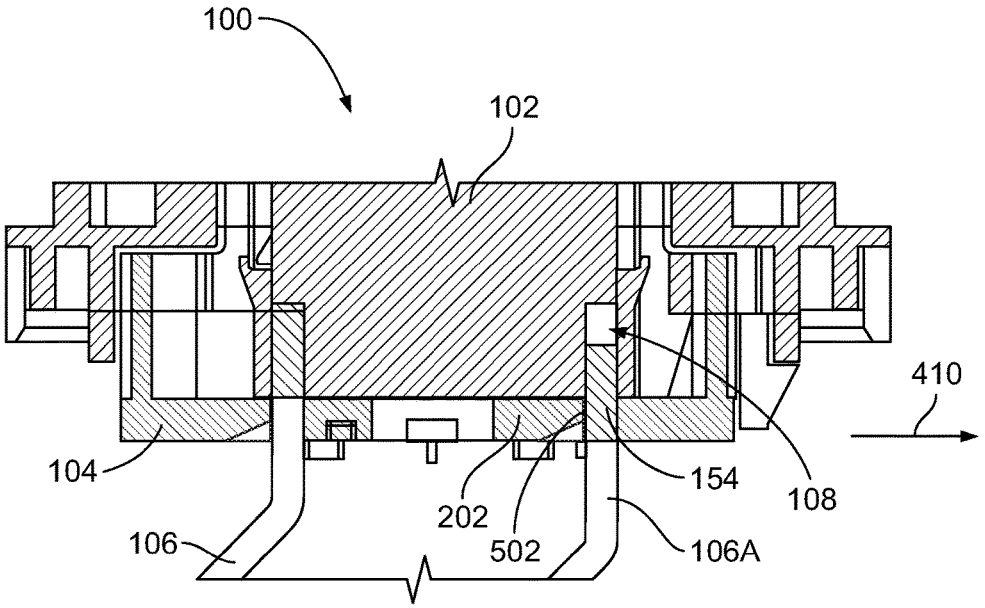
FIG. 13 is a top-down cross-sectional view showing a portion of the electrical connector with a blade terminal not fully loaded in a corresponding cavity of the housing.

FIG. 13 is a top-down cross-sectional view showing a portion of the electrical connector 100 with one of the blade terminals 106 is not fully loaded in the corresponding cavity 108 of the housing 102. The TPA device 104 is in the unlock position. Since one blade terminal 106A is not fully loaded in the corresponding cavity 108, the TPA device 104 cannot be actuated in the locking direction 410 to the lock position. For example, the ledge 202 abuts against the side 502 of the rib 154 instead of moving in the space behind the rib 154. The engagement between the ledge 202 and the side 502 of the rib 154 block additional movement in the locking direction 410. The TPA device 104 provides terminal position assurance because the obstructed movement indicates to the operator that at least one of the blade terminals 106 is not fully loaded.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely example embodiments. Many other embodiments and modifications within the spirit and scope of the claims will be apparent to those of ordinary skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

What is claimed is:

1. An electrical connector comprising:

a housing having a mating end and a mounting end, and defining multiple cavities;

multiple blade terminals held by the housing within the cavities, the blade terminals having two edge sides extending between two broad sides, each blade terminal including a first rib projecting from a first edge side of the two edge sides and a second rib projecting from a second edge side of the two edge sides, the first and second ribs of the same blade terminal projecting in opposite directions within the corresponding cavity; and a terminal position assurance (TPA) device coupled to the housing at the mounting end and movable relative to the housing between an unlock position and a lock position, the TPA device having a base plate that defines multiple terminal openings therethrough, wherein the base plate includes ledges that jut out into the terminal openings, wherein the ledges extend behind and align with the first and second ribs of the corresponding blade terminals when the TPA device is in the lock position to retain the blade terminals within the housing by abutting against back shoulders of the first and second ribs.

2. The electrical connector of claim 1, wherein the blade terminals are high voltage power terminals configured to convey DC electric power at voltages exceeding 300 volts.

3. The electrical connector of claim 1, wherein the broad sides of the blade terminals are wider in the location of the respective first and second ribs than along lengths of the blade terminals bordering the respective first and second ribs.

4. The electrical connector of claim 1, wherein the base plate includes first and second ledges that jut out into each of the terminal openings, the first ledge extending behind and aligning with the first rib of the corresponding blade terminal and the second ledge extending behind and aligning with the second rib of the corresponding blade terminal.

5. The electrical connector of claim 1, wherein the TPA device in the lock position is able to withstand at least 450 N of force exerted by each of the terminals on the base plate.

6. The electrical connector of claim 1, wherein the ledges of the base plate abut sides of the first and second ribs of the blade terminals to block movement of the TPA device from the unlock position to the lock position when the blade terminals are not fully loaded into the cavities of the housing.

7. The electrical connector of claim 1, wherein the cavities of the housing are oriented parallel to a cavity axis, and the TPA device is configured to linearly move along an actuation axis between the unlock position and the lock position that is perpendicular to the cavity axis.

8. The electrical connector of claim 7, wherein the TPA device includes a position-retaining latch that is elongated parallel to the actuation axis, the position-retaining latch having a hook feature that secures to a complementary catch feature on the housing when the TPA device is in the lock position to restrict movement of the TPA device towards the unlock position.

9. The electrical connector of claim 1, wherein the base plate has an inner side and an outer side opposite the inner side, the terminal openings extending through the base plate from the inner side to the outer side, the TPA device including mounting latches that project from the inner side of the base plate into the mounting end of the housing, the mounting latches having hook tips that engage corresponding catch features on the housing to couple the TPA device to the housing.

10. The electrical connector of claim 1, wherein each terminal opening of the base plate of the TPA device has a short region and a long region, wherein the ledges jut out along the short regions, wherein the long regions of the terminal openings align with the cavities of the housing when the TPA device is in the unlock position, and the short regions align with the cavities when the TPA device is in the lock position.

11. The electrical connector of claim 1, wherein the blade terminals have mating segments disposed within the cavities and termination segments disposed beyond the mounting end of the housing, the termination segments including contact plates configured to be mechanically secured to electrical components, the mating segments including the first and second ribs that project from the edge sides thereof.

12. The electrical connector of claim 1, wherein the blade terminals are high voltage power terminals configured to convey DC electric power.

13. An electrical connector comprising:

a housing having a mating end and a mounting end, wherein the housing includes a main body and a mounting flange connected to and extending outward from the main body, the main body defining multiple cavities, the mounting flange configured to be mechanically fastened to a panel, the housing including a compression seal held on a panel-facing side of the mounting flange;

multiple blade terminals held by the housing within the cavities, the blade terminals having two edge sides between two broad sides and a rib projecting from at least one of the two edge sides; and a terminal position assurance (TPA) device coupled to the housing at the mounting end and movable relative to the housing between an unlock position and a lock position, the TPA device having a base plate that defines multiple terminal openings therethrough, wherein the base plate includes ledges that jut out into the terminal openings, wherein the ledges extend behind and align with the ribs of the corresponding blade terminals when the TPA device is in the lock position to retain the blade terminals within the housing by abutting against back shoulders of the ribs, the compression seal surrounding a perimeter of the TPA device that is coupled to the main body.

14. An electrical connector comprising:

a housing having a mating end and a mounting end, and defining multiple cavities;

multiple blade terminals held by the housing within the cavities, the blade terminals having two edge sides extending between two broad sides and a rib projecting from at least one of the two edge sides; and a terminal position assurance (TPA) device coupled to the housing at the mounting end and movable relative to the housing between an unlock position and a lock position, the TPA device having a wherein the base plate that has an inner side that faces the housing and an outer side opposite the inner side, the base plate defining multiple terminal openings therethrough, the TPA device including cable routing fingers that project from the outer side of the base plate, wherein the base plate includes ledges that jut out into the terminal openings, the ledges extend behind and align with the ribs of the corresponding blade terminals when the TPA device is in the lock position to retain the blade terminals within the housing by abutting against back shoulders of the ribs.

15. An electrical connector comprising:

a housing having a mating end and a mounting end, and defining multiple cavities;

multiple blade terminals held by the housing within the cavities, the blade terminals having ribs projecting therefrom; and a terminal position assurance (TPA) device coupled to the housing at the mounting end and movable relative to the housing between an unlock position and a lock position, the TPA device having a base plate that defines multiple terminal openings therethrough, each terminal opening having a short region and a long region, the base plate including ledges that jut out into the terminal openings along the short regions, wherein the long regions of the terminal openings align with the cavities of the housing when the TPA device is in the unlock position such that the ledges are spaced apart from the ribs of the blade terminals, and wherein the short regions align with the cavities when the TPA device is in the lock position such that the ledges extend behind and align with the ribs of the blade terminals.

16. The electrical connector of claim 15, wherein each of the blade terminals has two edge sides between two broad sides, the ribs of the blade terminals projecting from the edge sides.

17. The electrical connector of claim 15, wherein the base plate includes two ledges that jut out into each of the terminal openings at corners thereof, the short regions of the terminal openings defined between the respective two ledges.

18. The electrical connector of claim 15, wherein the cavities of the housing are oriented parallel to a cavity axis, and the TPA device is configured to linearly move along an actuation axis between the unlock position and the lock position that is perpendicular to the cavity axis.

19. The electrical connector of claim 15, wherein the housing includes a main body and a mounting flange connected to and extending outward from the main body, the main body defining the cavities, the mounting flange configured to be mechanically fastened to a panel, the housing including a compression seal held on a panel-facing side of the mounting flange, the compression seal surrounding a perimeter of the TPA device that is coupled to the main body.

20. The electrical connector of claim 15, wherein the base plate has an inner side that faces the housing and an outer side opposite the inner side, the TPA device including cable routing fingers that project from the outer side of the base plate.

* * * * *